US006276095B1

(12) United States Patent
Tripsianes

(10) Patent No.: US 6,276,095 B1
(45) Date of Patent: Aug. 21, 2001

(54) DOME STRUCTURE

(76) Inventor: Lazaros C. Tripsianes, 4416 Church St., Skokie, IL (US) 60076

( * ) Notice: Subject to any disclaimer, the term of this patent is extended or adjusted under 35 U.S.C. 154(b) by 0 days.

(21) Appl. No.: 09/295,655

(22) Filed: Apr. 21, 1999

(51) Int. Cl.[7] ..... E04B 1/343

(52) U.S. Cl. ..... 52/81.1; 52/80.1; 52/80.2; 52/81.2; 135/102; 135/104; 135/125; 135/135; 135/136

(58) Field of Search ..... 52/81.6, 2.15, 52/80.2, 745.07, 81.1, 81.2, 80.1; 135/102, 104, 125, 135, 136

(56) References Cited

U.S. PATENT DOCUMENTS

| | | | | |
|---|---|---|---|---|
| 1,976,188 | | 10/1934 | Nozawa . | |
| 2,670,818 | | 3/1954 | Hacker . | |
| 2,753,818 | | 7/1956 | Green . | |
| 3,300,942 | * | 1/1967 | Horstman | 52/742 |
| 3,649,401 | | 3/1972 | Gunnerson . | |
| 3,893,270 | | 7/1975 | Schupack et al. . | |
| 3,922,827 | * | 12/1975 | Rosenblatt | 52/245 |
| 4,265,259 | | 5/1981 | Gillis . | |
| 4,277,922 | | 7/1981 | McAllister . | |
| 4,326,363 | * | 4/1982 | Leonhardt et al. | 52/80 |
| 4,473,976 | * | 10/1984 | Kuznetsov et al. | 52/80 |
| 4,589,236 | | 5/1986 | McAllister . | |
| 4,998,552 | * | 3/1991 | Kiksic et al. | 135/102 |
| 5,117,852 | | 6/1992 | Bryant . | |
| 5,170,599 | | 12/1992 | Knight . | |
| 5,408,793 | | 4/1995 | Dykmans . | |

FOREIGN PATENT DOCUMENTS

| | | |
|---|---|---|
| WO 93/23630 | 11/1993 | (WO) . |
| WO 96/38292 | 12/1996 | (WO) . |

* cited by examiner

*Primary Examiner*—Carl D. Friedman
*Assistant Examiner*—Christy M. Syres
(74) *Attorney, Agent, or Firm*—Wallenstein & Wagner, Ltd.

(57) ABSTRACT

A support structure including a first and a second upper ring member. The support structure further includes a lower circular foundation of a diameter greater than the diameters of the first and second upper ring members. A plurality of initially straight and elongated structural members extend from each of the upper ring members. Extending from each of the ring members are an equal number of structural members. The structural members extend radially at angular intervals on both the upper and lower rings. Each of the structural members have a first and a second lateral end. The structural members are secured at their first lateral ends to either the first or second upper ring members. The structural members are further secured at their second lateral ends to the lower foundation. Thereafter, the structural members are manipulated to create a lattice formation comprised of S-shaped, elastically-modified structural members. The upper and lower ring members are fixed to each other, while the structural members are connected at overlapping points with fasteners to create a lightweight structure of high relative stiffness.

28 Claims, 13 Drawing Sheets

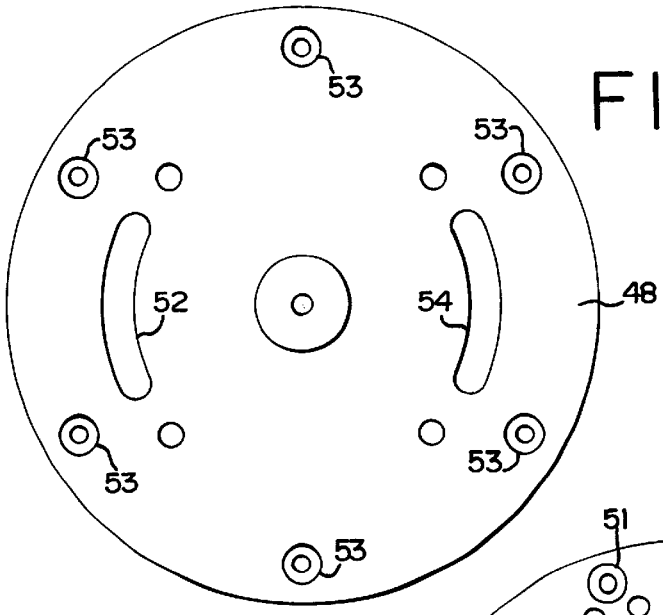
FIG. 7
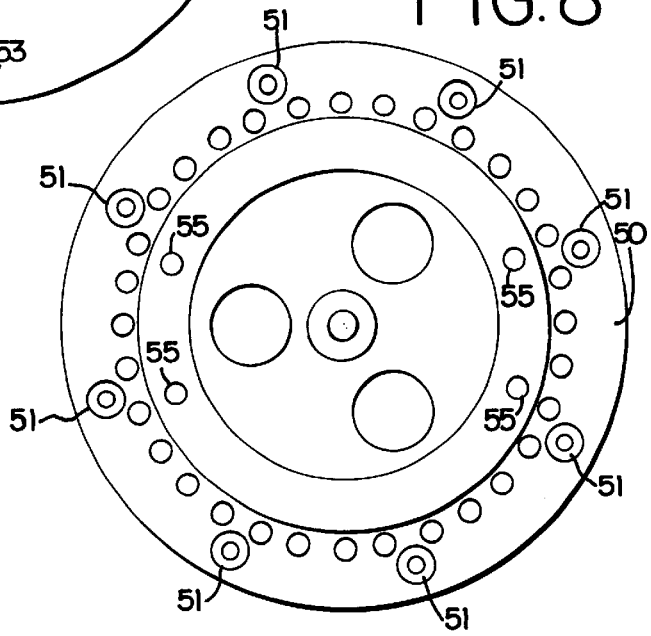
FIG. 8
FIG. 6
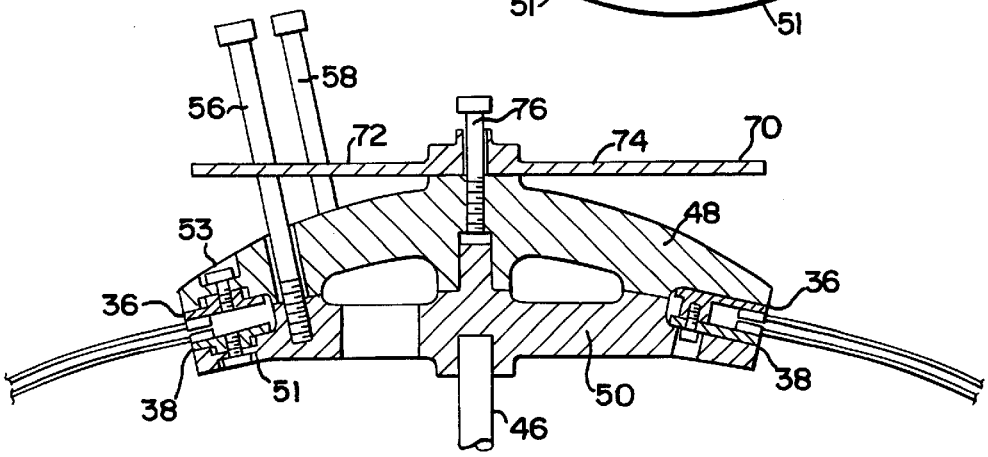

DOME STRUCTURE

DESCRIPTION

1. Technical Field

This invention relates generally to a support structure and, more particularly, to a support structure for a domed building and a method of making that structure.

2. Background of the Invention

The prior art discloses various configurations for supporting different kinds of structures. Specifically, U.S. Pat. No. 5,408,793 ("the '793 patent") is directed to a dome structure. As may best be seen in FIG. 10 thereof, the '793 patent discloses a structure having an outer base 44, an inner base 43, and outer 39 and inner membranes 16, respectively. Generally, these outer and inner membranes are inflated and are held down from uplift forces by concrete members anchored to the ground. Alternatively, the membranes are tailored to a specific shape and are positioned on the inner or outer bases. FIG. 7 of the '793 patent shows the wire structure underlying this dome.

U.S. Pat. No. 5,117,852 ("the '852 patent") is directed to a free-standing structure. As may best be seen in FIG. 2 of the '852 patent, the structure has a polygonal base. In particular, FIG. 2 shows a pentagonal base. At each of the points of the pentagon there are two arch members 16. The arch members are elongated and have two opposite ends, a first end and a second end. The first end of each of the arch members emanates from the same point on the pentagon. Each of these arch members 16 whose first end emanates from this same point crosses over the other arch member. The second ends of the respective arch members 16, however, are secured to the pentagon at different points.

U.S. Pat. No. 4,265,259 ("the '259 patent") is directed to a tent and may best be seen in FIGS. 1 and 2 thereof. The '259 patent discloses a series of stressed, arcuate rods 11 which surround a convex polyhedra such as a hemispherical structure.

U.S. Pat. No. 3,922,827 ("the '827 patent") is directed to a hyperbolic tower structure. As shown in FIG. 1, the '827 patent discloses a tower structure consisting of a central vertical frame shaft surrounded by an outer structure in the form of a hyperboloid of revolution composed of two sets of intersecting straight linear structural elements arranged to define the hyperboloid. The linear elements are connected at their intersections to the central shaft by horizontal radial bracing members.

U.S. Pat. No. 3,893,270 ("the '270 patent") is directed to a pressure vessel comprising a walled body formed of concrete. This concrete walled body is built upon a wire frame. Each of the wires making up this frame is prestressed. Further, each of these wires extends continuously throughout the length of the body within the wall of the body between first and second anchor locations which are positioned at a same general longitudinal location. The structure of these wires is best seen in FIG. 2. The '270 patent discloses that the wires are positioned at a same general longitudinal location along the cylindrical member of the structure.

U.S. Pat. No. 3,649,401 ("the '401 patent") is directed to a method of making an ornamental structure for supporting a piece of furniture. Essentially, the structure of the '401 patent is comprised of a pair of end plates to which strands are attached. The strands are saturated with a polyester resin which hardens to provide the structure with rigidity.

U.S. Pat. Nos. 2,753,818 ("the '3818 patent") and 2,670,818 ("the '0818 patent") are directed to structures supporting a hemispherical dome. As can best be seen from FIGS. 2 and 3 of the '3818 patent and FIGS. 5–6, 10, and 12–13 of the '0818 patent, these domes are supported by radially extending ribs 13 and b, respectively. The ribs of the '3818 and '0818 patents do not cross over any of the other ribs thereof.

U.S. Pat. No. 1,976,188 ("the '188 patent") is directed to an arcuate metal structure serving as a truss. FIGS. 1 and 2 of the '188 patent disclose that this structure is made of rods or unit-elements 1 that are configured in a pure arc, i.e., as "parabolic, semi-circular and other convexed curvatures of substantially continuous nature." (emphasis added) (See '188 patent, page 1, lines 3–6.) One end of each unit element 1 touches the ground, while the other end of each unit element 1 is secured to the frame of one of the two arches. (See especially FIG. 1.)

SUMMARY OF THE INVENTION

The support structure of the present invention includes at least one upper ring member, and more preferably two upper ring members, and a plurality of structural members in a lattice formation extending downward from and secured to the upper ring member. The support structure also includes a lower foundation member having a diameter greater than the diameters of the upper ring members, and most preferably, the diameter of the lower foundation member is equal to at least three times the diameter of the upper ring member or members.

According to one aspect of the present invention the structural members comprise a plurality of initially straight and elongated structural members which extend from the upper ring members. Preferably, each of the elongated structural members have a substantially circular cross section. Each of the elongated structural members have a first and a second lateral end. The elongated structural members extend radially outward from the upper ring members at equal angular intervals thereof. Further, each of the elongated structural members are secured adjacent their first lateral ends to the upper ring members. In the embodiment having first and second upper ring members, an equal number of elongated structural members extend from and are secured to each of the ring members. As such the elongated structural members preferably alternate being secured to and extending from the first ring member and the second ring member, respectively, with a first structural member extending from the first upper ring, a second structural member extending from the second upper ring, a third structural member extending from the first upper ring, a fourth structural member extending from the second upper ring, and so on. The elongated structural members are secured adjacent their second lateral ends to the lower foundation.

According to another aspect of the present invention, the initially straight, elongated structural members are elastically deformed or modified. As such the structural members assume a generally S-shaped lattice configuration between the upper member and the lower foundation. The S-shaped lattice configuration of the structural members contributes to the strength of the support structure.

According to another aspect of the present invention, after the structural members are elastically deformed to form the S-shaped lattice configuration each of the structural members overlap portions of adjacent structural members at connection points.

According to another aspect of the present invention, the structural members are secured to overlapping structural members at the connection points with fasteners.

According to another aspect of the present invention, at least two methods for manufacturing or installing the support structure of the present invention, including variations thereof, are provided.

Other features and advantages of the invention will be apparent from the following specification taken in conjunction with the following drawings.

BRIEF DESCRIPTION OF THE DRAWINGS

To understand the present invention it will now be described by way of example, with reference to the accompanying drawings in which:

FIG. 6 is a cross-sectional side elevation view of a portion of the structure of FIG. 5 taken through lines 6—6 of FIG. 5;

FIG. 7 is a top plan view of an upper portion of the device for rotating the first and second upper ring members of FIG. 5;

FIG. 8 is a top plan view of a lower portion of the device for rotating the first and second upper ring members of FIG. 5;

DETAILED DESCRIPTION OF THE PREFERRED EMBODIMENT

Figure 1:
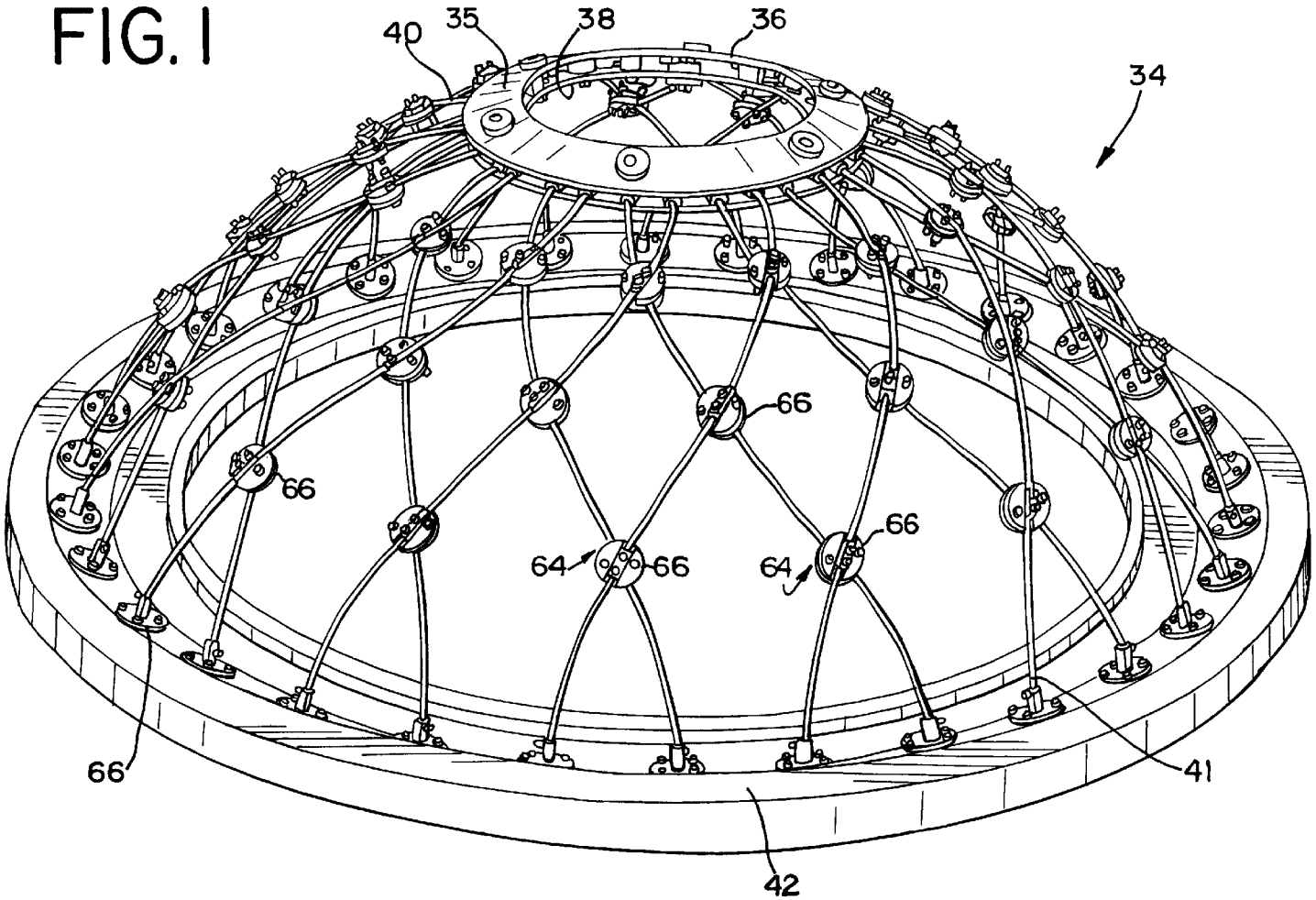
FIG. 1 is a perspective view of a prototype finished support structure in accordance with the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 9:
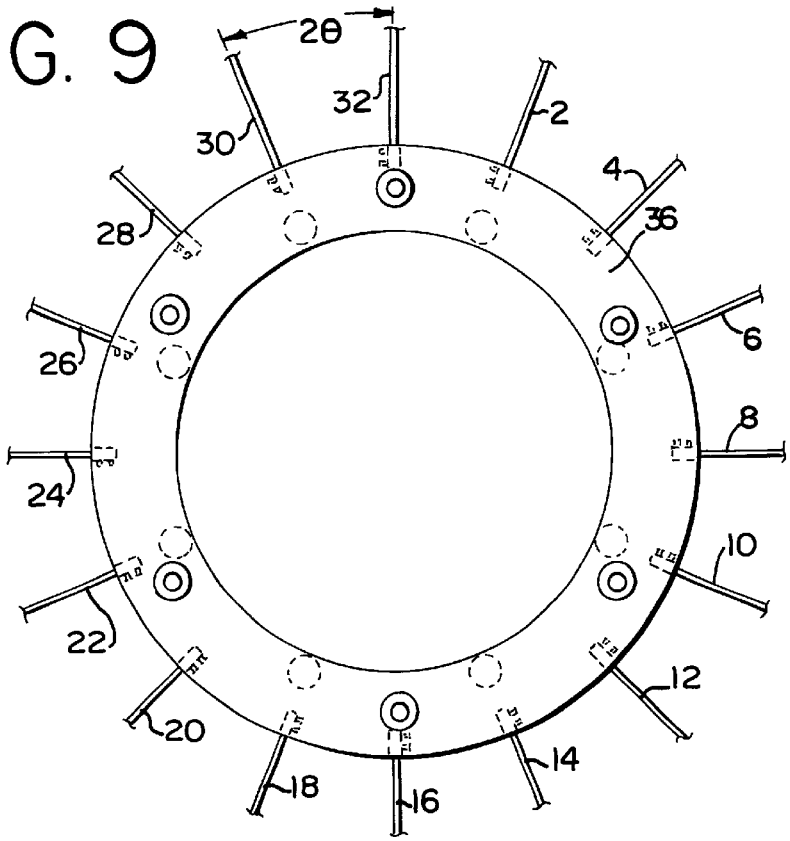
FIG. 9 is a top plan view of the first upper ring member illustrating an alternative attachment of the structural members.
Figure 10:
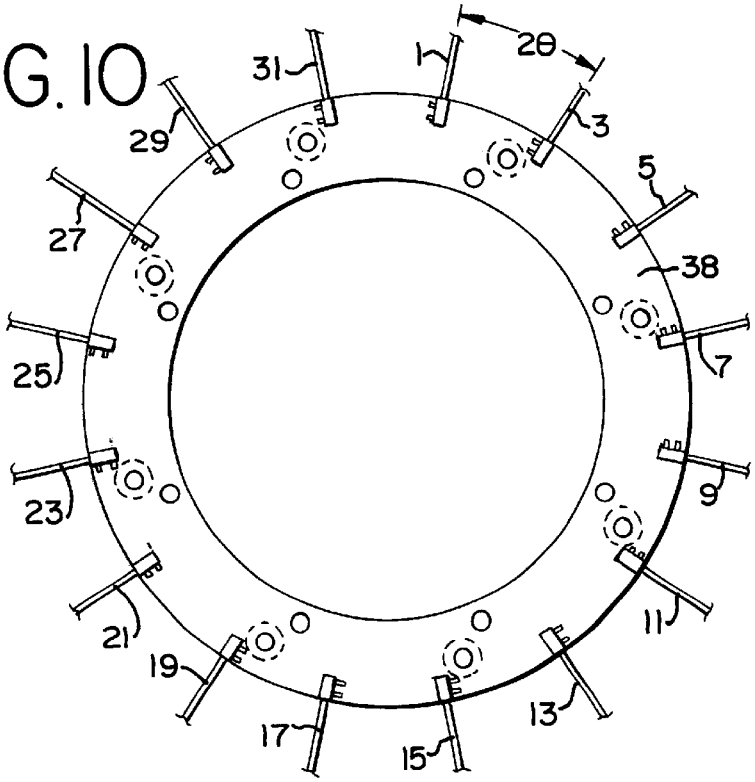
FIG. 10 is a top plan view of the second upper ring member illustrating an alternative attachment of the structural members.
Figure 11:
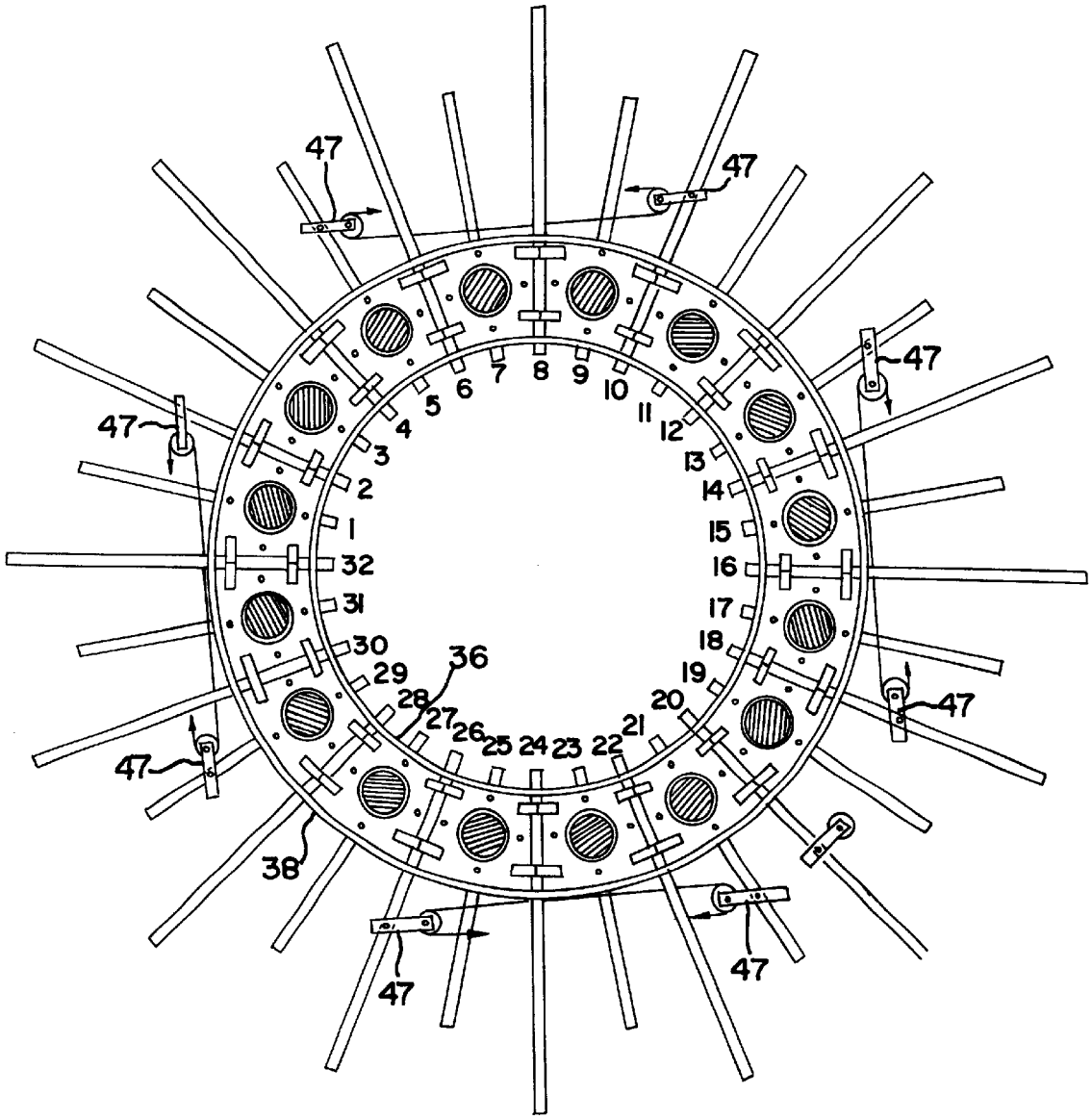
FIG. 11 is a top plan view of the first and second upper ring members with a plurality of initially straight elongated structural members extending from the upper ring members, and including another means for rotating the first and second upper ring members relative to each other to offset the rings from their original positions.

Referring now in detail to the Figures and initially to FIG. 1, there is shown a preferred embodiment of the dome support structure 34 constructed in accordance with the present invention. FIGS. 2–4 and 9–10 illustrate various structure and steps in a first process or method for manufacturing the support structure 34. Additionally, FIGS. 5–8 illustrate various structure and steps in accordance with manufacturing a "model" of the dome support structure 34. FIG. 11 illustrates a variation of the first method for manufacturing the support structure 34. Finally, FIGS. 11–17 illustrate various structure and steps in a second process or method for manufacturing the support structure.

The support structure 34 illustrated in FIG. 1 is made using a number of elements. As may be seen in FIG. 1, the structure 34 includes an upper member 35 which, in the embodiment illustrated in FIG. 1, comprises a first upper ring member 36 and a second upper ring member 38. These ring members 36, 38 may be a girder or truss type ring design made of composite or lightweight metallic material which can withstand high stress, and which exhibit high stiffness characteristics. These ring members 36, 38 are preferably, but not necessarily, substantially identical in size, specifically including in their inner and outer diameters. While the upper member 35 is described as including a first and a second ring member, it is understood that the upper member 35 may be comprised of a single ring member. It is further understood that the shape of the member 35, including the components thereof, does not have to be that of a ring. Additionally, the shape of the upper member 35 and the lower foundation 42 could be oval, hexagonal, or some other shape. It is important, however, that the connection points of the structural members to the upper member and the connection points of the structural members to the lower foundation be of the same shape, but of different scale. If the connection points form a shape other than circular, it is preferred that the method of manufacture of the dome structure for this configuration be under Method II herein.

Figure 2:
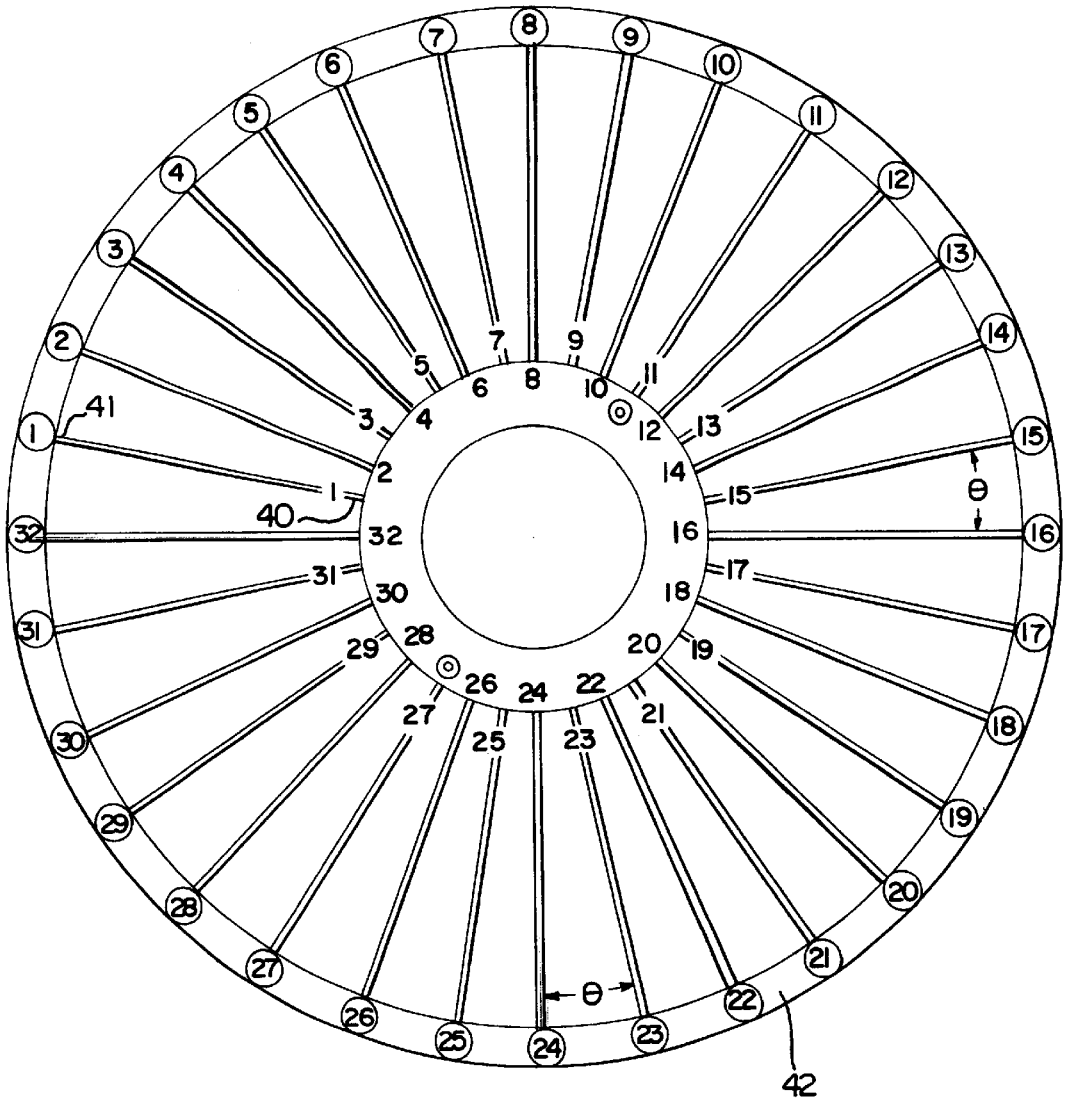
FIG. 2 is a top plan view of the first and second upper ring members with a plurality of initially straight elongated structural members extending from the upper ring members.
Figure 3:
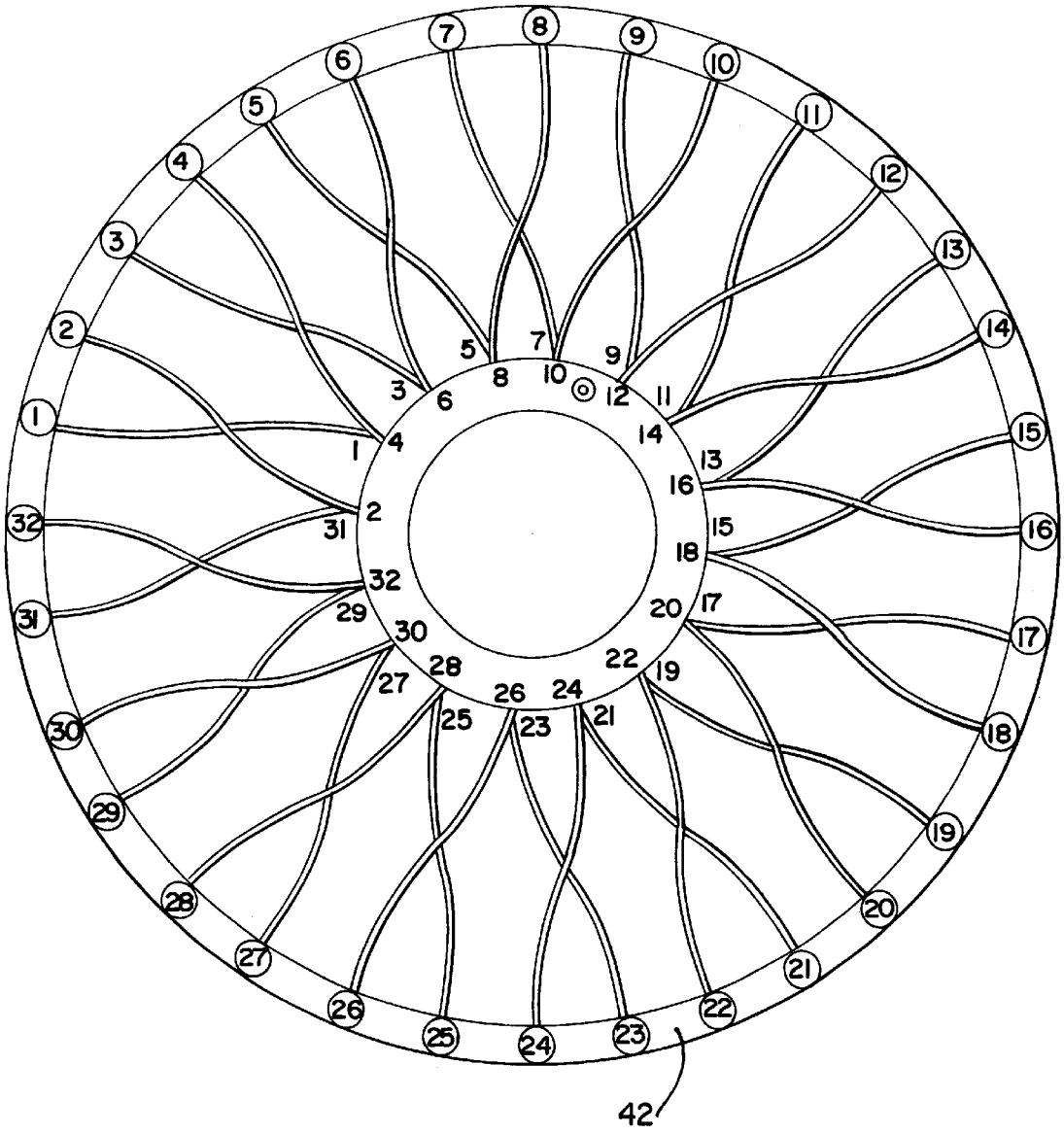
FIG. 3 is a top plan view of the structure of FIG. 2 after the first and second upper ring members have been rotated relative to each other and offset from their original positions.
Figure 4:
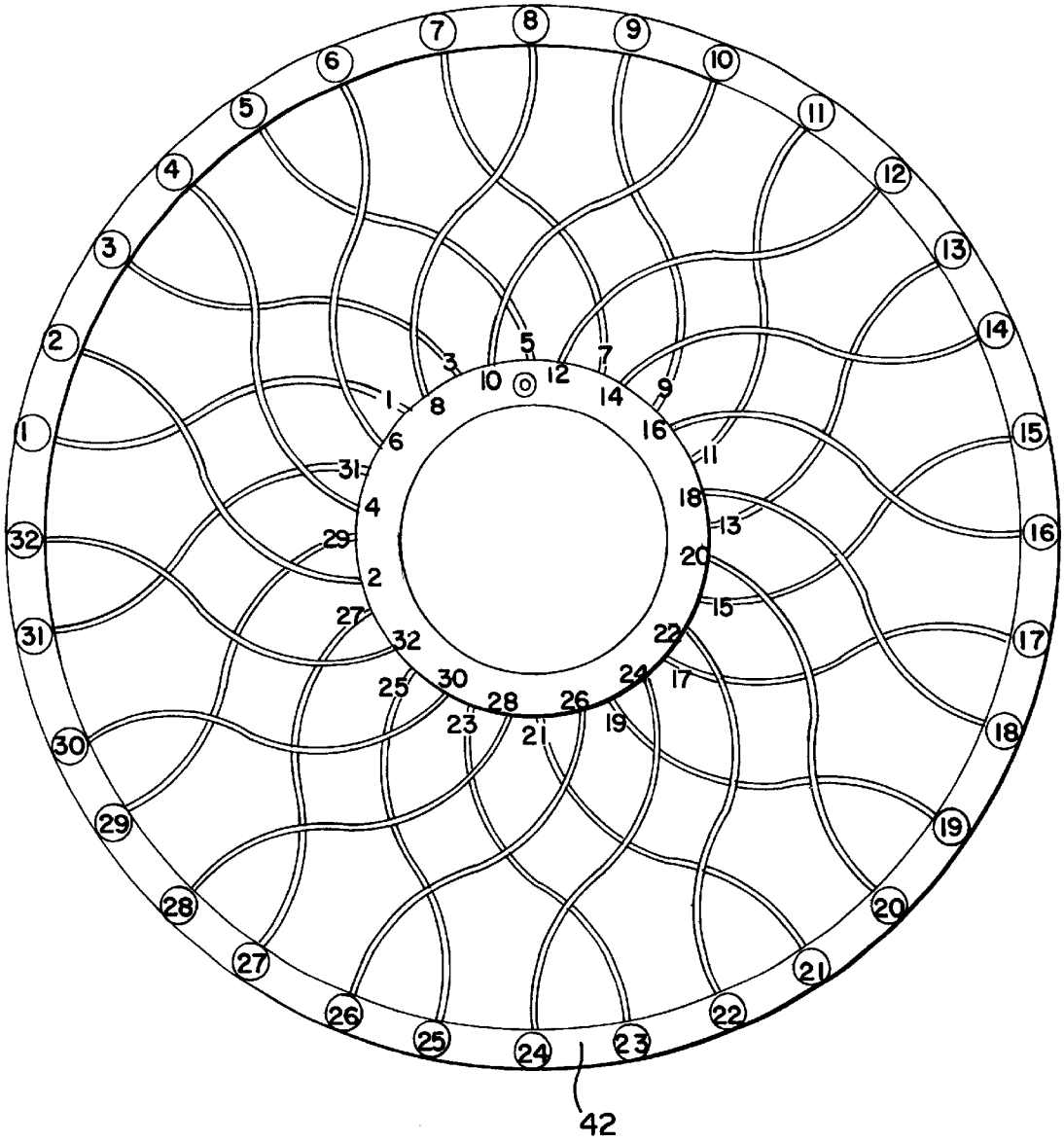
FIG. 4 is a top plan view of the structure of FIG. 3 after the first and second upper ring members have been rotated relative to each other and offset from the end positions of FIG. 3 by an additional angle.

A plurality of initially straight and elongated structural members extend from the upper ring member 35. As illustrated in FIGS. 2–4 there are thirty-two elongated structural members which are identified as structural members 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, and 32, and which are generally secured to one of rings 36, 38. Where the support structure 34 includes a numerically even number of structural members 1–32, as is the case in the embodiment illustrated in FIGS. 2–4, one structural member is generally diametrically opposed to a corresponding structural member.

For example, structural member 1 is diametrically opposed to structural member 17; structural member 2 is diametrically opposed to structural member 18; structural member 3 is diametrically opposed to structural member 19; structural member 4 is diametrically opposed to structural member 20; structural member 5 is diametrically opposed to structural member 21; and so on. In the event that the number of structural members selected was an odd number, then the structural members would not necessarily be diametrically opposed.

The structural members 1–32 are generally substantially similar in physical characteristics, i.e., they are each made of the same material, are each of a substantially identical diameter and length, etc. . . . In the preferred embodiment, the structural members 1–32 are also generally circular. The term "circular" in the context of the structural members 1–32 of this invention is intended to mean that members 1–32 have a generally circular cross-section. In the case of the circular structural members 1–32, they may generally have cross sections that are either in the form of solid rods, hollow tubes, or some other form of a generally circular cross section. Optionally, however, the structural members 1–32 may have a cross-section that is other than circular. Generally, each of the structural members 1–32 is made of a high tensile steel. Alternatively, the structural members 1–32 may be made of a composite material (carbon-reinforced or other material). As shown in FIGS. 9 and 10, an equal number of these initially straight and elongated structural members extend from each of upper rings 36 and 38. In this embodiment wherein two upper rings 36, 38 form the upper member 35, an equal number of structural members extend from rings 36 and 38 in an alternating manner. For example, even-numbered members 2, 4, 6, 8, 10, 12, 14, 16, 18, 20, 22, 24, 26, 28, 30, and 32 extend from first upper ring member 36, and odd-numbered members 1, 3, 5, 7, 9, 11, 13, 15, 17, 19, 21, 23, 25, 27, 29, and 31 extend from the second upper ring member 38.

Moreover, as is seen in FIG. 2, each of the elongated structural members 1–32 extend radially to and at equal angular intervals ($\theta$) from the upper member 35. The general formula for $\theta$ in any given structure having equal angular spacing between structural members is $\theta=360°/\chi$, wherein $\chi$ equals the number of structural members. Because the embodiment of FIGS. 1–4 includes thirty-two structural members, $\theta$ for this particular embodiment is 360°/32 or 11.25°. In an embodiment having thirty-six structural members, $\theta$ would be 360°/36 or 10°. As may also be seen in FIGS. 9 and 10, when upper member 35 includes a first upper ring 36 and a second upper ring 38, the structural members 1–32 extend from both the first upper ring 36 and second upper ring 38. In the preferred embodiment, the structural members alternate extending from the first and second upper ring members. As such, the angular separation of the sixteen (16) adjacent structural members on either the first upper ring 36 or the second upper ring 38 is two times $\theta$, i.e., (2)*(11.25°), or 22.50°.

As shown in FIG. 2, each of the elongated structural members 1–32 have a first lateral end 40 and a second lateral end 41. Generally, the first lateral end 40 or area adjacent the end thereof is secured to either the first upper ring member 36 or the second upper ring member 38 of the upper member 35. Similarly, generally the second lateral end 41 or the area adjacent the end thereof of each of the elongated structural members 1–32 is secured to a connecting support member on the lower foundation 42.

The lower foundation 42 of the present embodiment, illustrated in FIG. 1, is generally configured in a circular or ring shape. However, as noted above with respect to the upper member 35, the lower foundation 42 may comprise any shape. It is preferable, however, that when completed, the series of connection points between the second lateral ends of the structural members 1–32 and the lower foundation 42 forms the shape of a circle. This lower circle or lower diameter is formed by the series of connection points between the structural members 1–32 and the lower foundation 42 and generally has a diameter greater than the diameters of the first 36 and second upper ring members 38. Similarly, the diameter of the upper circle or ring is formed by the series of connection points between the structural members 1–32 and the upper member 35. Most preferably, the diameter of the lower circle of the foundation 42 is at least three times the diameter of each of the upper circle of the upper member 35 or first and second rings 36, 38.

Figure 5:
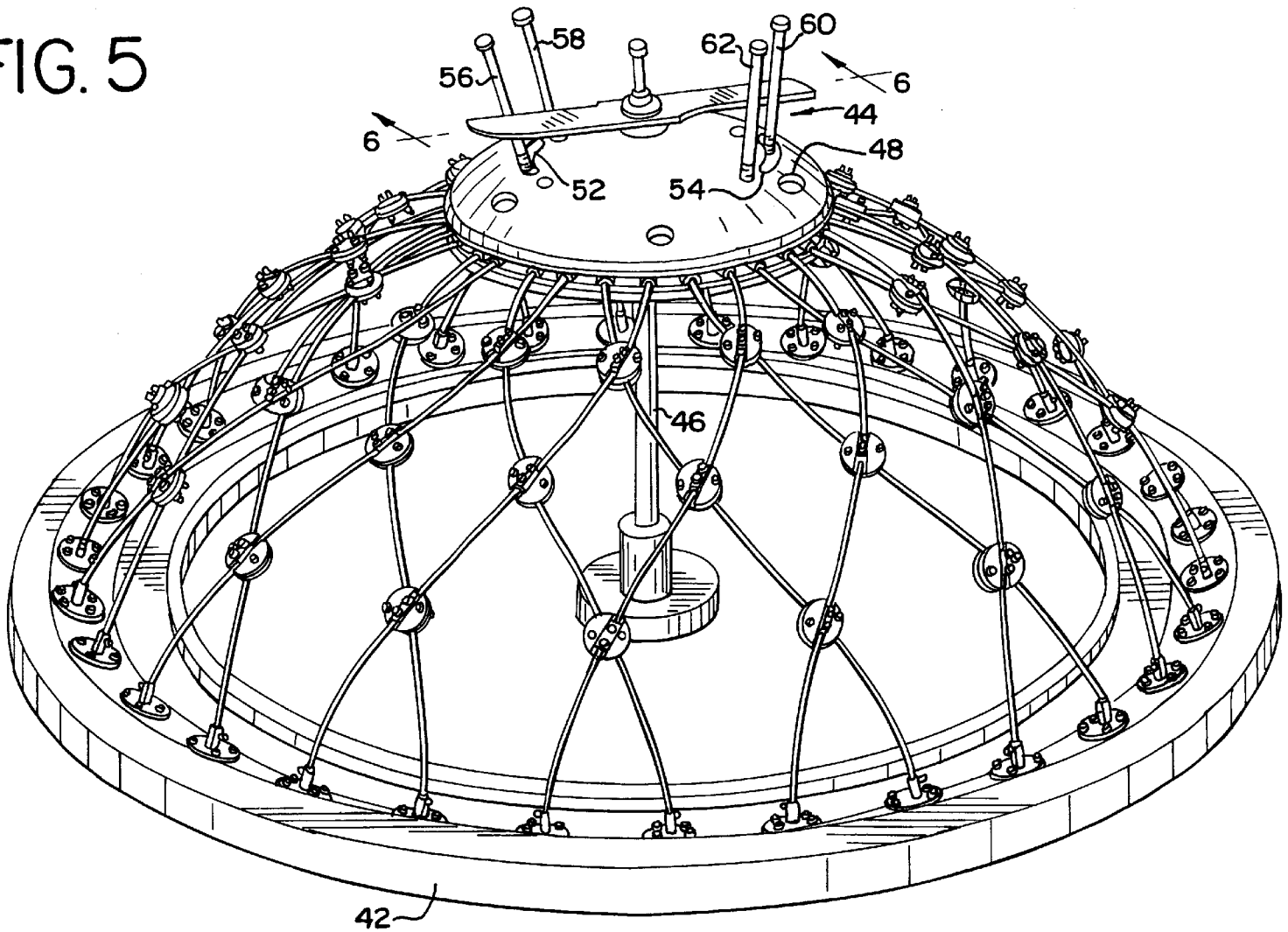
FIG. 5 is a perspective view of the structure of FIG. 4, shown in model size, after final rotation of the first and second ring members through a total angle of $\gamma$ as illustrated in FIG. 4, and including the attachment of the support structure to the lower foundation and securement of the overlapping structural members with fasteners.

One example of a "model" embodiment of the invention was manufactured by the inventor and is illustrated in FIG. 5. In this "model" embodiment, the first upper ring member 36 and second upper ring member 38 have an outer diameter of nine (9) inches, and an inner diameter of six and one half (6½) inches. The height of the support structure 34 from the top of the first upper ring 36 to the base of the lower foundation 42, was approximately nine and one-half (9½) inches. The lower foundation 42 of this embodiment had a circular ring shape. Its inner diameter was approximately twenty-two (22") inches, and its outer diameter was approximately thirty (30") inches. Thus, the outer diameter of the lower foundation 42 was actually somewhat greater than three times the outer diameter of the first and second upper ring members 36, 38. Additionally, in this "model" example the structural members were made of a solid high tensile steel ($S_y$=240,000 psi., and E=30,000 ksi.) having a circular cross-section with a diameter of one-sixteenth (1/16") of an inch. The structural members 1–32 in this embodiment were obtained from the O'Hare Spring Company, Des Plaines, Ill. 60016.

As explained as being preferred above, in the "model" example the elongated, circular structural members 1–32 are initially straight when extending from the first and second ring members 36,38. Ultimately, however, each of these initially straight, elongated- circular, structural members 1–32 are elastically modified to attain a generally S-shaped configuration as shown in FIG. 5. This generally S-shaped configuration and the resulting lattice configuration that is formed contributes to phenomenal strength for the support structure 34, permitting the support structure 34 to bear very high loads. It is believed that the support structure 34 of the present invention can effectively withstand tremendous forces applied to the top or to the side of the dome support 34. Specifically, it is believed that the dome structure 34, due to its unique design methodology, exhibits a very high stiffness to weight ratio which is believed to be superior to existing dome structures.

While it is conceivable that the support structure 34 of the present invention can be made in a variety of different ways, two such methods for creating the identified support structure 34 in accordance with the present invention will be described below in detail. The first method is described by reference to FIGS. 2–4 and 9–10. Additionally, two subsets of the first embodiment are shown in FIGS. 5–8 and FIG. 11, respectively. The second method is described by reference to FIGS. 12–16.

Method I:

The basic concept of the method employed in the first method is to rotate the two upper ring members 36,38 with respect to one another. Relative rotation of the first and second rings members 36,38 with the structural members 1–32 connected thereto, provides for elastically deforming the structural members 1–32 to form the lattice configuration shown in FIG. 1.

In this method the sixteen even numbered structural members 2,4,6,8,10,12,14,16,18,20, 22,24,26,28,30, and 32 are connected to the lower surface of the first upper ring member 36 as shown in FIGS. 1, 6 and 9. This first plurality of structural members could be connected to either the upper or lower surface or portion of the first upper ring member. Similarly, the odd sixteen numbered structural members 1,3,5,7,9,11,13,15,17,19,21,23,25,27,29, and 31 are connected to the upper surface of the second upper ring member 38 as shown in FIGS. 1, 6 and 10. Like the first plurality of structural members connected to the first upper ring member, the second plurality of structural members connected to the second upper ring member could be connected to either the upper or lower surface or portion thereof. The exact vertical location of the structural members on the specific ring members is not critically important. What is important is that the structural members connected to the first and second upper ring members be vertically offset (as shown in FIG. 6) to allow a minimum clearance for the structural members to overlap each other during rotation thereof.

As shown in FIG. 2, the first upper ring 36 is placed in an initial relative position concentrically over the second upper ring member 38, and is rotatably connected to the second upper ring member 38. Alternately, the first upper ring member 36 may be placed concentrically over and secured to the second upper ring member 38 prior to the securement of the structural members 1–32 to the respective upper ring 36, 38. In that configuration the first and second upper ring members 36, 38 would be rotatably connected and then the respective structural members 1–32 would be attached to the appropriate ring member 36,38.

As may be seen from the Figures, especially FIG. 2, each of the elongated-circular structural members 1–32 extend radially, like the spokes from the hub of a wheel, at equal angular intervals θ, alternating on both the first and second upper rings 36, 38. As noted above, each of these structural members 1–32 have a first and a second lateral end 40, 41. The first lateral end 40 of each of the structural members 1–32 is secured to either the first upper ring member 36 or the second upper ring member 38. As such, the first lateral ends 40 of the structural members 1–32 are cantilevered from the respective ring member 36,38. As best shown in FIG. 6, the structural members connected to the first upper ring 36 are located above the structural members connected to the second upper ring 38. This is required to allow the structural members 1–32 and upper rings 36,38 to be rotated with respect to each other without concern for lateral interference with adjacent structural members 1–32. If instead a single upper member 35 is utilized it is important that adjacent structural members 1–32 be offset in the vertical direction to allow the structural members to cross without interference as will be described below.

After the structural members 1–32 are connected to the first and second upper rings 36,38, and after the first and second rings 36,38 are rotatably connected to each other to form the combined upper member 35, the combined upper member 35 with structural members 1–32 extending radially therefrom is raised to a predetermined elevation using a temporary column positioned at the center of the circular foundation.

Next, the second lateral ends 41 of the elongated structural members 1–32 which radially extend in a cantilevered manner from the upper member 35 are pulled downwardly towards the lower foundation 42. In order to avoid the presence of horizontal loads on the temporary column the second lateral ends 41 of each of two diametrically opposed structural members are simultaneously pulled downwardly towards the lower foundation 42. For example, the respective second lateral ends 41 of each of structural members 1 and 17 are simultaneously pulled downwardly towards the foundation 42. Then, after this diametrically opposed pair of second lateral ends is pulled down to the foundation 42, the second lateral ends of each of members 1 and 17 are secured to the foundation 42 at their corresponding connection locations.

Next, for example, the respective second lateral ends 41 of structural members 9 and 25 are pulled downwardly towards, and subsequently secured to the lower foundation 42 at the appropriate connection point. Then, for example, the respective second lateral ends 41 of structural members 6 and 22 are pulled downwardly towards, and subsequently secured to the lower foundation 42 at the appropriate connection point. This process continues until all of the structural members 1–32 are secured to the lower foundation 42.

It is understood that the length of each structural member 1–32 is greater than the distance between the connection point of the first lateral end 40 of the structural member 1–32 and the upper member 35, and the connection point of the second lateral end 41 of the structural member 1–32 and the lower foundation 42. This will become more obvious following further explanation of the manipulation of the structural members 1–32 to form final S-shaped lattice configuration. As such, following the securement of the second lateral ends 41 of the structural members to the lower foundation 42, each structural member 1–32 extends out at an exaggerated arc between the respective connection points at the upper member 35 (or upper ring members 36,38 as appropriate) and lower foundation 42. The additional length of the structural members 1–32 identified as the exaggerated arc length of the structural members between the upper member and the lower foundation, is required to allow the structural members to be elastically manipulated during subsequent manufacturing steps as identified below.

After all of the structural members 1–32 have been secured to the lower foundation 42 the structural members 1–32 we alter their substantially straight and elongated state, as shown in FIG. 2. There are many possible ways of producing the end configuration/lattice as shown in FIGS. 5–8 and FIG. 11.

Specifically, FIGS. 5–8 disclose one means for achieving the end configuration of FIG. 1. This means is initially designed for the "model" or prototype size example embodiment. In the first example of this method an apparatus 44 as shown in FIGS. 5 and 6 may be used to accomplish the relative rotation of the first upper ring member 36 and the second upper ring member 38. The apparatus 44 is made up of two main components, a lower base member or column 46 and an upper disc member 48. The lower base member 46 has the shape of a vertical cylinder and may be utilized to raise the first upper ring member 36 and the second upper ring member 38 to an appropriate height. The upper disc member 48 includes a convex upper surface. The lower base member 46 and upper disc member 48 together facilitate the necessary relative rotation of the first ring member 36 and second ring member 38 which results in the final configuration, as shown in FIGS. 1 and 5.

As shown in FIGS. 5 and 7, the upper disc member 48 (see especially FIG. 7) has a pair of diametrically opposite arcuate slots 52,54 formed in the convex upper surface thereof. As may best be seen in FIG. 6, the upper disc member 48 is positioned above the second upper ring member 38. The slots 52 and 54 in the upper disc member 48 are positioned radially inwardly of the perimeter of the upper disc member 48. At such locations the slots 52 and 54 do not overlie any portion of the second upper ring member 38 when the upper disc member 48 is positioned above the second upper ring member 38. Rather, the slots 52,54 overlie and extend above a flange portion 50 of the lower base member 46.

As best shown in side view of FIG. 6, the lower base member 46 is removably secured to the second upper ring member 38. In this "model" embodiment the lower surface of the second upper ring member 38 has male bosses thereon. And, the upper surface of the flange portion 50 of the lower base member 46 has approximately eight counterbored holes 51 which are dimensioned to allow the boss to fit therein. The lower base member 46 may also be secured to the second upper ring member with fasteners, including bolts. Alternatively, the flange portion 50 of the base member 46 may include sockets, and the second upper ring member 38 may have complementary teeth which engage those sockets. When the teeth engage the sockets the second upper ring member 38 and the flange portion 50 are secured together such that there can be no relative rotation between the flange portion 50 of the base member 46 and the second upper ring member 38.

As may also be seen in FIG. 6, the upper disc member 48 is secured to the first upper ring member 36 in a similar manner described above. The upper disc member 48 has approximately six counterbored holes 53 which are dimensioned to allow a fastener or a boss on the first upper ring member 36 to be positioned through the hole and mated with upper disc member 48. This stabilizes and immobilizes the first upper ring member 36 with respect to the upper disc member 48.

Next, in the method of manufacturing the "model" embodiment, as may be seen in FIGS. 5 and 6, four rods or handles 56, 58, 60, and 62 are provided for facilitating relative rotation of the first and second upper ring members 36,38. Two of the rods or handles 58 and 62 are secured to upper disc member 48. The other two rods or handles 56 and 60 have threaded ends. These threaded ends of rods 56 and 60 are inserted through the arcuate slots 52 and 54, respectively, in the upper disc member 48 and extend to the flange member 50. The threaded ends of rods 56 and 60 are then secured into a first set of complementary threaded bores 55 in the flange member 50 of the lower base member 46.

In a small scale setting such as the "model" prototype, in order to cause relative rotation of the first and second upper ring members 36,38, an individual grasps rods 56 and 58 in one hand, and rods 60 and 62 in the other hand. Using steady pressure, the individual moves rods 56 and 58 with one hand, and rods 60 and 62 with the other hand, towards each other through an angle of preferably between 25° and 32.5°. This rotation of the first and second upper ring members 36,38 provides the relative rotation as shown from FIG. 2 to FIG. 3. When this initial rotation has been completed a brake mechanism 70 (see FIGS. 5 and 6) is employed to prevent the ring members from rotating to their initial positions. As shown in FIGS. 5 and 6 the brake mechanism 70 is rotatably connected to upper disc member 48 by using a large shaft 76 fixed at the center point of the upper disc member 48. The brake mechanism 70 has opposed members 72,74 which engage the rods 56,60 to prevent rotation thereof. Next, a second set of threaded rods or handles are placed in a second set of threaded bores that have appeared near the ends of the slots 52 and 54 due to the rotation of the ring members. Additionally, threaded rods 56 and 60 can be removed from the flanged member 50. The individual then again grasps the rods 56 and 58 in one hand, and rods 60 and 62 in the other hand, and moves them towards each other, again through an additional angle of preferably between 25° and 32.5°. This second rotation provides for the transition from FIG. 3 to FIG. 4. The total relative rotation between the first upper ring member 36 and the second upper ring member 38 at the completion of this process is between 50° and 65°. This is the preferred relative rotation between the first upper ring member 36 and the second upper ring member 38. This angle (preferably 50° to 65°) is the preferred extent of relative rotation, i.e., offset, between the first upper ring member 36 and the second upper ring member 38.

During the relative rotation described above, the structural members 1–32 undergo an elastic change in shape from their initially straight orientation, as shown in FIG. 2, to an S-shaped configuration, as shown in FIGS. 4 and 5. After the desired rotation has been achieved the first upper ring 36 and the second upper ring 38 are permanently secured to each other, preventing the ring members 36,38 and structural members from springing back to their original state.

A second means of rotating the first and second upper ring members 36,38 and attached structural members 1–32 is illustrated in FIG. 11. In this embodiment pulley mechanisms 47 are employed. One pulley mechanism 47 is attached to a structural member which is connected to the first upper ring member 36 and one puller mechanism 47 is attached to a structural member which is connected to the second upper ring member 38. The opposing structural members are directed or pulled toward one another. The effect of his manipulation is that the first and second upper ring members 36,38 will rotate with respect to one another as required in the first manufacturing method and as illustrated in FIGS. 2 and 4. As shown in FIG. 11, various sets of pulley mechanisms 47 may be employed simultaneously or in steps to effect the final lattice of the structural members. In the embodiment shown in FIG. 11 four sets of pulley mechanisms are employed, however it is believed that multiple sets of pulley mechanisms may be utilized as needed. These sets of pulley mechanisms need to be employed in such a way so that they are spaced from each other at equal angular intervals, and are engaged in a manner so that the network of generated forces are counteracted and neutralize each other.

After the required rotation has been achieved, the first upper ring 36 and the second upper ring 38 are permanently secured to each other to prevent the two rings from springing back to their original, equilibrium state. At this stage, many of the formerly straight structural members 1–32 overlap each other at cross points 64 as shown in FIG. 1. At the cross points 64 the overlapping structural members 1–32 are secured to each other, preferably with fasteners 66 that secure overlapping members. This interlocking contributes greatly to the high stiffness characteristics of the structure 34, in both vertical and horizontal directions.

Method II:

In a second method of manufacturing the above-described invention as illustrated in FIGS. 12–16, the structural members 1–32 themselves are individually manipulated instead of individually rotating the upper ring member 35. Similar to the Method I, the upper member 35 may be comprised of two components 36,38 or it may be comprised of a single member. With Method II, the second lateral ends 41 of the structural members are manipulated and the first lateral ends 40 and upper member 35 remain fixed in position. No rotation of the upper member 35 is required. Accordingly, if two ring members 36,38 are utilized with Method II, they should be fastened together. With either embodiment, however, it is important that the structural members 1–32 attached to the upper member 35 be offset in the vertical direction. Preferably, alternating structural members 1–32 are spaced a distance above or below, respectively, adjacent alternating structural member 1–32. Preferably, the structural members are spaced a distance of one diameter (center to center distance) of the structural members.

Similar to Method I above, the sixteen even numbered structural members are connected to the upper member 35 at a location above or below the sixteen odd numbered structural members.

Figure 12:
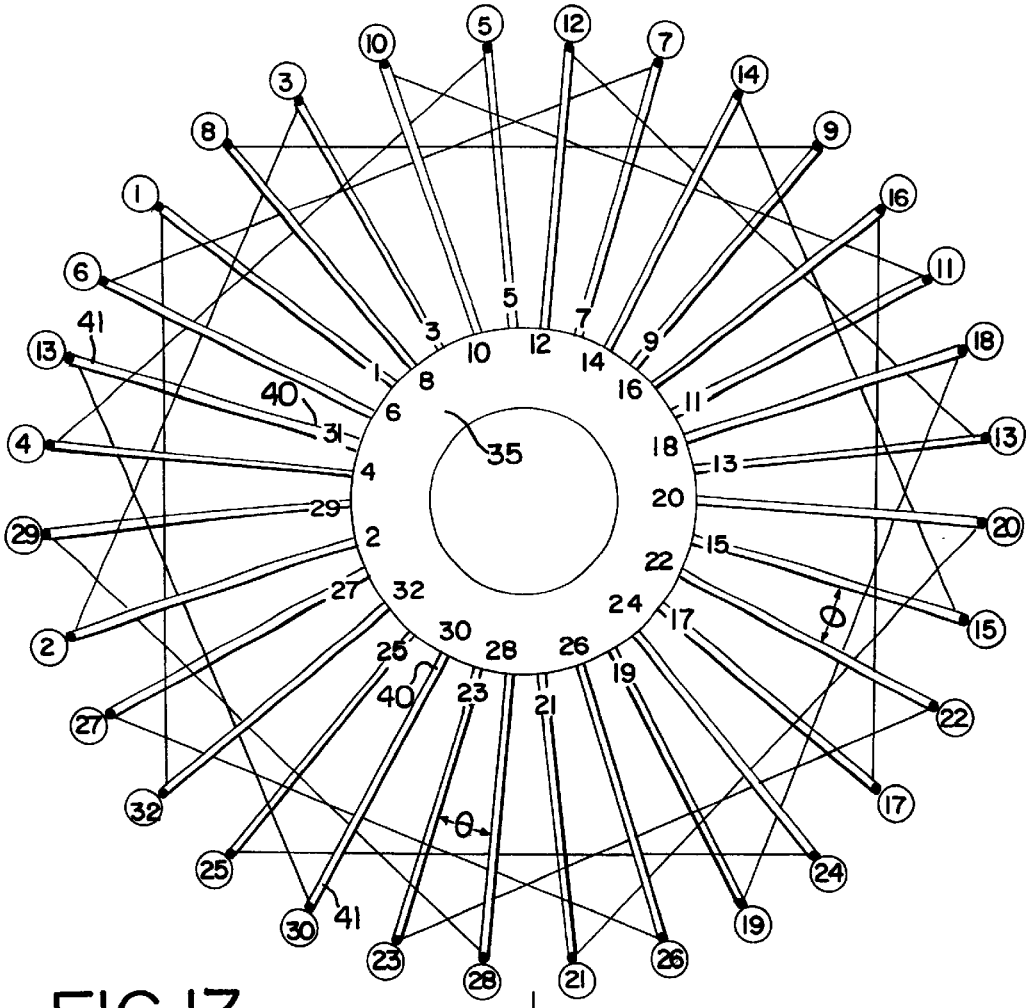
FIG. 12 is a top plan view of a plurality of initially straight elongated structural members extending from an upper ring member before angular manipulation of the structural members.
Figure 13:
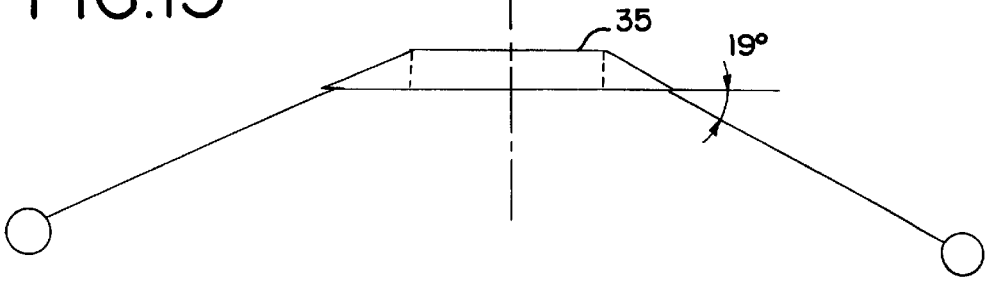
FIG. 13 is a partial side elevation view of the structure of FIG. 12.

As shown in FIG. 12, the structural members 1–32 are secured to the upper member 35 at the first lateral end 40 thereof. The elongated structural members 1–32 extend radially from the upper member 35 at equal angular intervals θ as described above. The structural members 1–32 are thus cantilevered from the upper member 35. The structural members 1–32 may be connected to the upper member radially at an angle of 0° to the horizontal plane including at an angle as shown in FIG. 13. In FIG. 13 the structural members 1–32 are connected to the upper member 35 at an angle of 19°. It has been found that connecting the radial members 1–32 at an inclined angle promotes formation of the final dome shaped structure during the various erection steps described herein.

Next, the upper member 35 and attached structural members 1–32 are raised to a predetermined elevation above the lower foundation 42 using a temporary column (similar to the previously described column) positioned at the center of the lower foundation 42 to maintain the upper member 35 at the predetermined elevation. Other means including cranes may be utilized.

Figure 14:
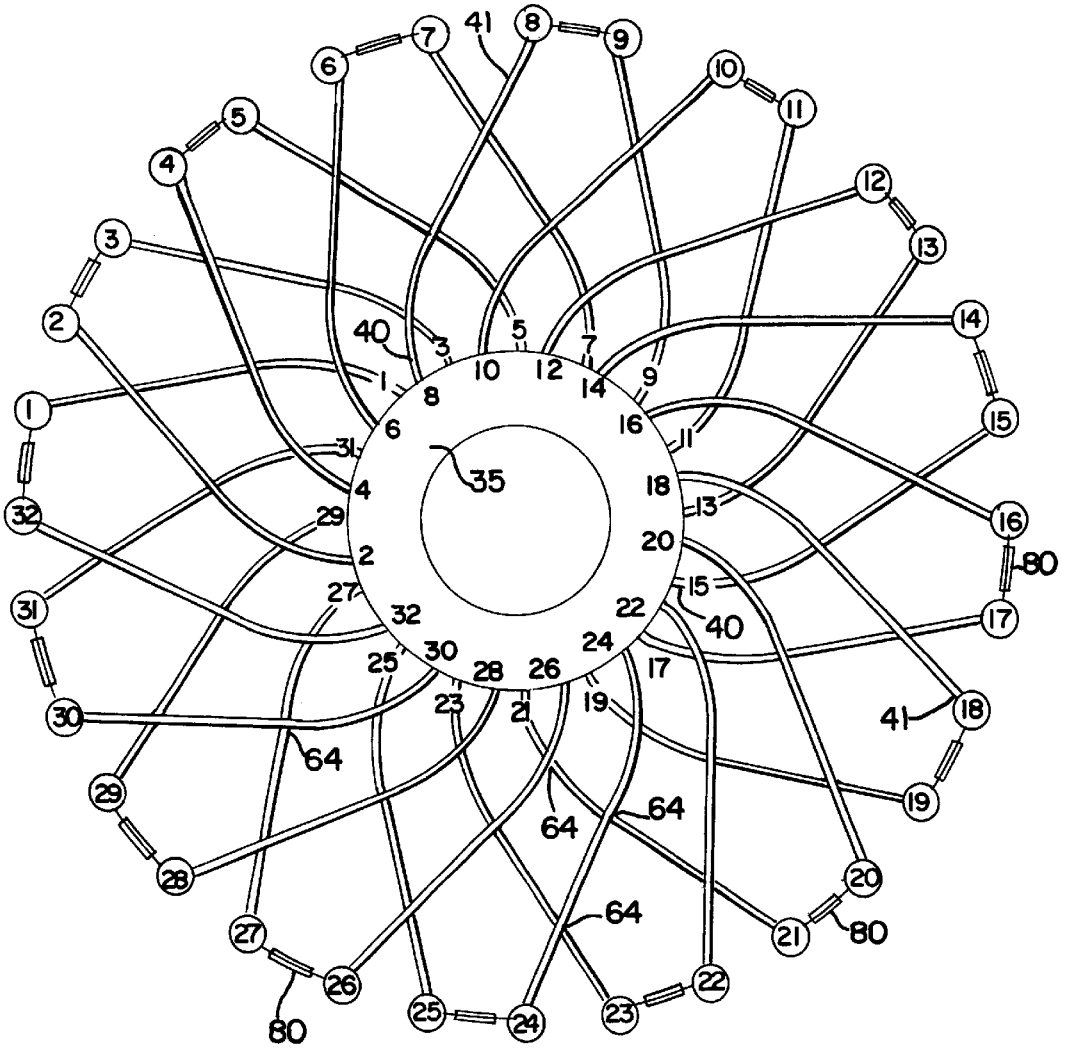
FIG. 14 is a top plan view of the structure of FIGS. 12 and 13 after first manipulation of the structural members from their original positions.

After the upper member 35 and attached structural members 1–32 are raised, motorized pulley mechanisms are connected in a prescribed order to the second lateral ends 41 of pairs of structural members 1–32 in a predetermined-paired manner. Specifically, structural member 1 is connected to structural member 32, structural member 2 is connected to structural member 3, structural member 4 is connected to structural member 5, structural member 6 is connected to structural member 7, structural member 8 is connected to structural member 9, structural member 10 is connected to structural member 11, structural member 12 is connected to structural member 13, structural member 14 is connected to structural member 15, structural member 16 is connected to structural member 17, structural member 18 is connected to structural member 19, structural member 20 is connected to structural member 21, structural member 22 is connected to structural member 23, structural member 24 is connected to structural member 25, structural member 26 is connected to structural member 27, structural member 28 is connected to structural member 29, and structural member 30 is connected to structural member 31. Once each of the structural members have been appropriately connected to their paired structural member 1–32, the second lateral ends 41 of the each of the paired structural members (members 1 and 32 for example purposes) are simultaneously directed toward one another until a specified distance is reached. This is effectuated by shortening the length of the pulley mechanism connecting each paired structural member toward the center of the pulley mechanism. The specified distance is approximately equal to the center to center distance of two adjacent supports of the circular foundation. The second lateral ends 41 of each pair of structural members are directed or pulled toward one another in a synchronized order. The final configuration wherein each of the ends of the paired structural members have been pulled toward each other is illustrated in FIG. 14. After the pairs of structural members have been initially manipulated the cable/pulley mechanisms are replaced with rigid pivot-type strut supports 80 as shown in FIG. 14.

Figure 15:
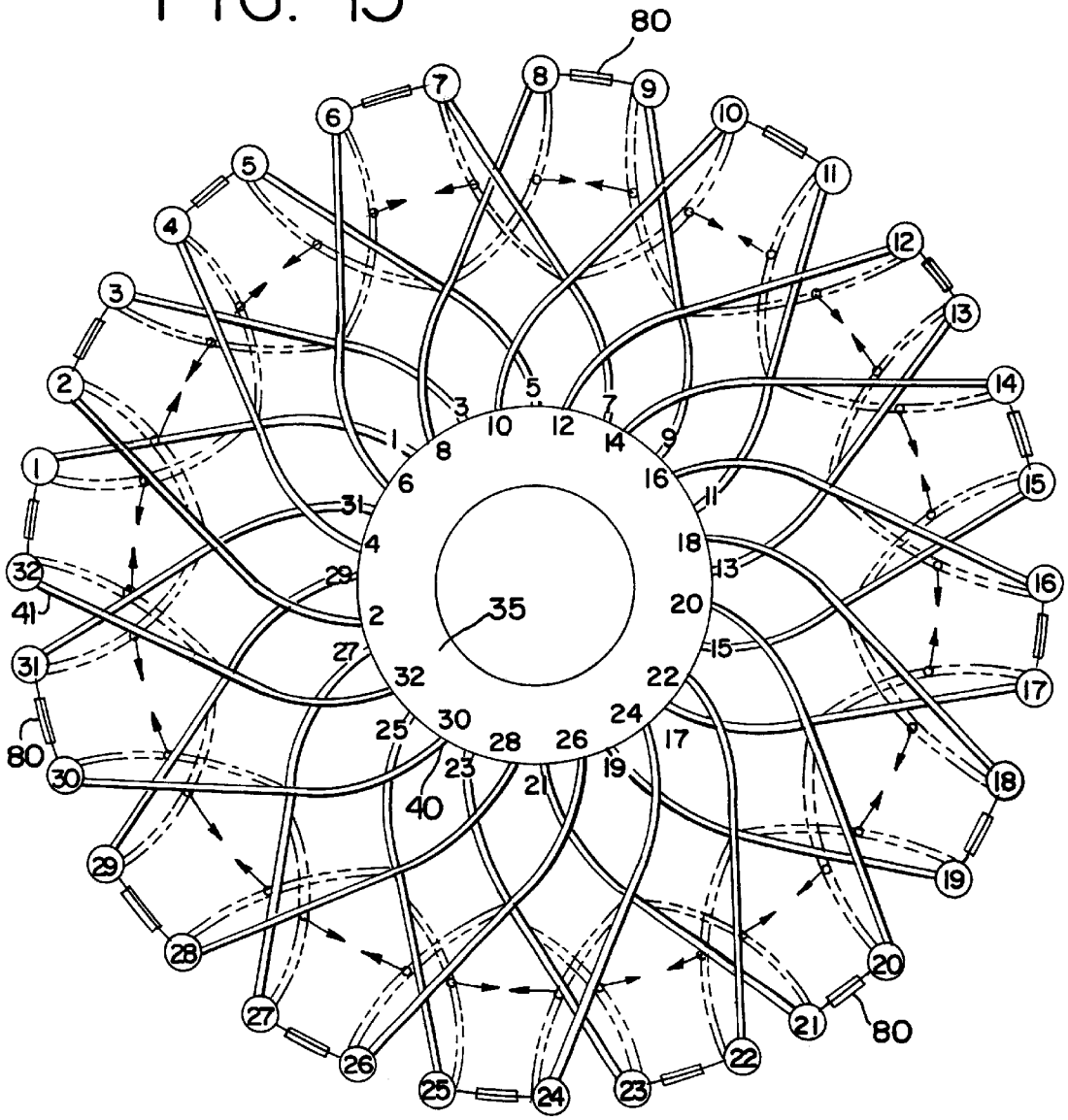
FIG. 15 is a top plan view of the structure of FIGS. 12 and 13 illustrating a second manipulation of the structural members from their positions as shown in FIG. 14 to a final position.
Figure 16:
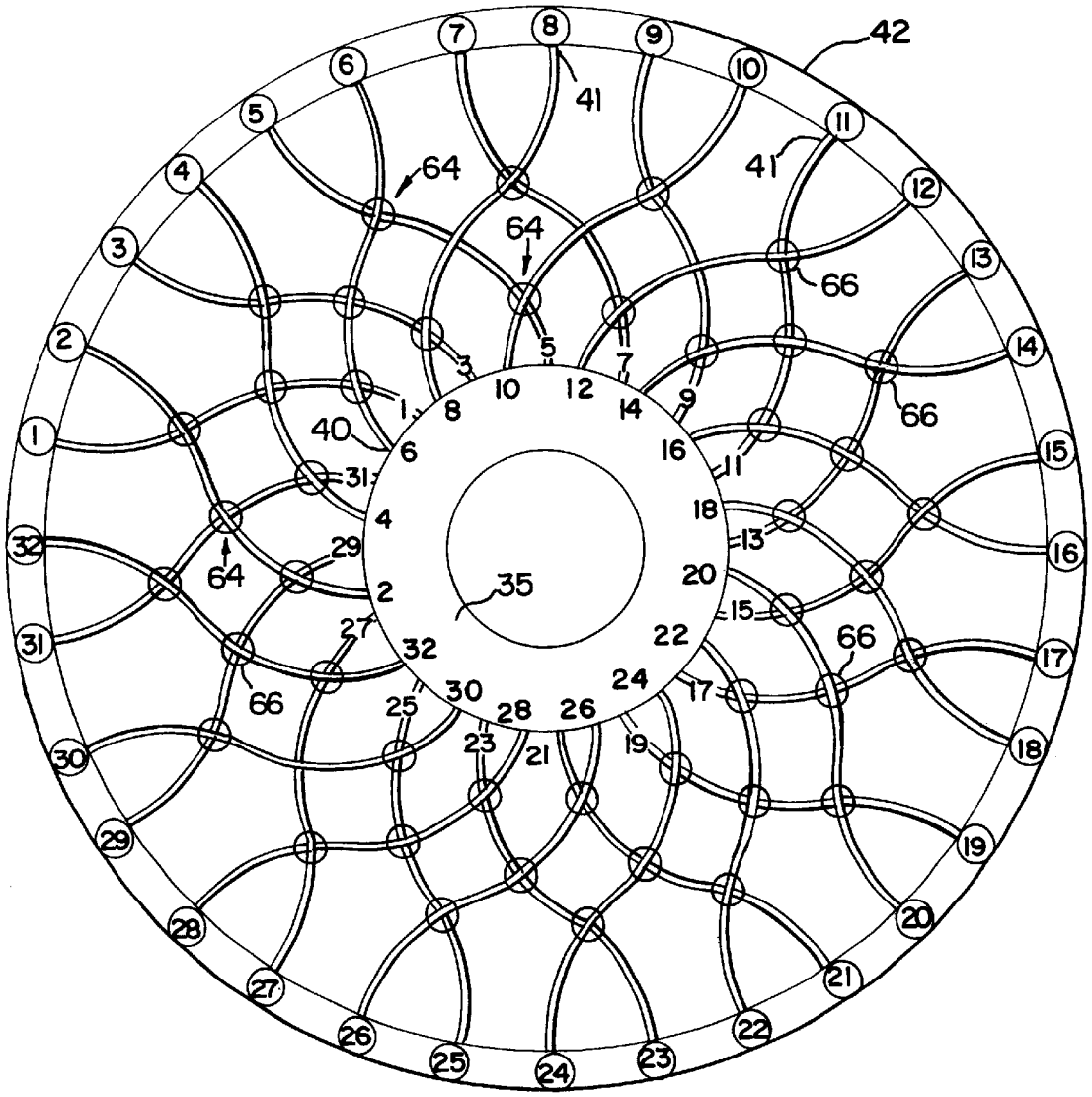
FIG. 16 is a top plan view of the support structure of the present invention following: final manipulation of the support structures as illustrated in FIG. 15, attachment of the support structure to the lower foundation, and securing the overlapping structural members with fasteners; and, FIG. 17 is a side elevation view of an alternate support member for connecting the structural members to the lower foundation.

Next, a similar cable/pulley mechanism is connected to the same pairs of structural members identified above at a selected location between the first lateral end 40 of the structural member and the second lateral end 41 of the structural member. As shown in FIG. 15, this location is approximately one-fourth of the overall length of the structural member from the second lateral end 41 thereof. The pairs of structural members are then directed or pulled toward one another, contributing to further elastically deform the structural members. The structural members 1–32 are preferably manipulated at this second location until the second lateral end 41 of each structural member 1–32 forms substantially a right angle (+ or −about 5°) with the rigid strut members connecting the second lateral ends 41 of the pairs of structural members.

During this process of elastic manipulation, the lattice structure of the overlapping structural members transforms from the earlier conical shape (shown in FIG. 13) to that having a semi-spherical shape by directing the second lateral ends 41 of the structural members closer to each other. As such, the circumference of the circle created by the second lateral ends 41 of the structural members is nearly identical with the circumference of the lower foundation 42. The final configuration wherein each of the ends of the paired structural members have been pulled toward each other is illustrated in phantom lines in FIG. 15. Additionally, at this time strut supports may be placed to join adjacent pairs of structural members, i.e., structural member 1 may be joined to structural member 2, structural member 3 may be joined to structural member 4, and so on.

The structure is then lowered to the lower foundation 42. The second lateral ends 41 of the structural members 1–32 are further elastically manipulated to continue transformation of the structure from the above-described conical shape (shown in FIG. 13) to the spherical shape of the dome structure. Next, the second lateral ends 41 are anchored to the lower foundation 42 at the connection points. This process continues until all of the structural members 1–32 are fully aligned and secured to the lower foundation 42. At this point we release all of the puller/cable tensioners and struts. This allows the structure to achieve its natural dome-shaped configuration.

After manipulation of the structural members 1–32, many of the formerly straight structural members 1–32 overlap at cross points 64. The overlapping structural members 1–32 are secured to each other with fasteners 66 to achieve the final design of FIG. 16.

Figure 17:
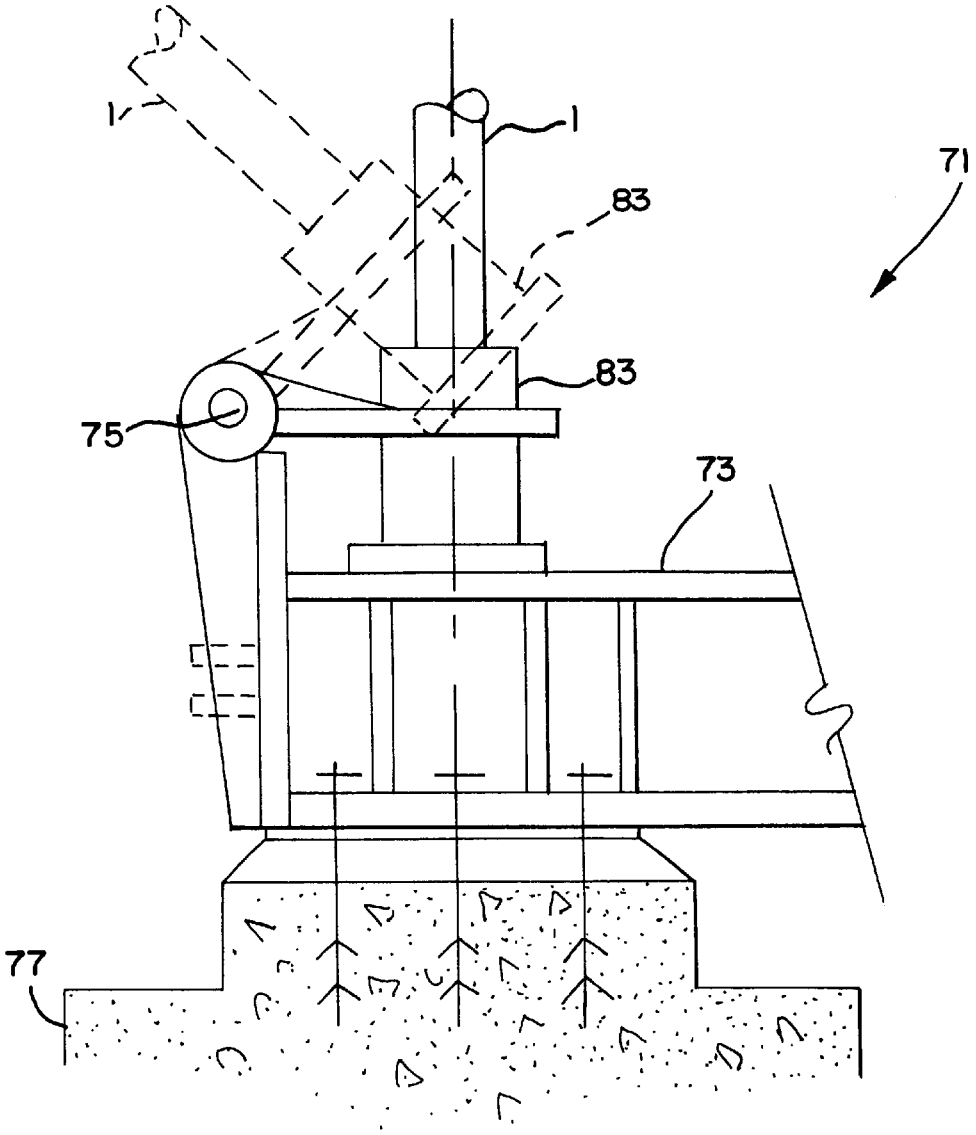

As a variation to the above method, instead of elastically deforming the structural members into the final lattice configuration using strut supports and then connecting the second lateral ends 41 into fasteners 66, after the pairs of structural members undergo their initial manipulation by the cable/pulley mechanisms, as shown in FIGS. 13 and 14, the second lateral ends 41 of the structural members may be connected to pivot type anchor mechanisms 71 as shown in FIG. 17. The anchor mechanisms 71 comprise a pivotable member 83 and a beam member 73. In a preferred embodiment, pairs of pivotable members 83 are connected to the beam member 73 at opposite ends thereof. The pivotable members 83 are rotatable about a shaft 75 to allow the structural member, with the use of the pulley mechanisms, to undergo deformation in subsequent phases. At the end of the subsequent deformation of the structural members, the second lateral end 41 of the structural members forms a substantially right angle with the beam member 73. At this point the anchor mechanisms 71 have been rotated to their final positioning and are fixed to the beam member 73. The beam member 73 will then be anchored to the lower foundation or to some other foundational member 77. The advantage of such a support mechanism is that the major moments of the paired structural members attached at opposite ends of the beam member are counteracting and therefore neutralizing each other, thus stopping the transfer of what might have been critical loading to the lower foundation.

While the specific embodiments have been illustrated and described, numerous modifications come to mind without significantly departing from the spirit of the invention and the scope of protection is only limited by the scope of the accompanying Claims.

What I claim is:

1. A support structure, comprising:

(A) a first upper ring member having a diameter;

(B) a second upper ring member having a diameter, (C) a lower foundation having a diameter greater than the diameters of said first and second upper ring members; and (D) a plurality of integral structural members extending radially from each of said upper ring members, said structural members having a first lateral end and a second lateral end, wherein each of said structural members are secured adjacent their first lateral ends to either said first or second upper ring members, and wherein said structural members are secured adjacent their second lateral ends to said lower foundation, and wherein a portion of said structural members distal their first and second lateral ends overlaps a portion of adjacent structural members between the upper ring members and the lower foundation.

2. The support structure of claim 1, wherein said integral structural members are elastically modified to form a generally S-shaped configuration between said upper ring members and said lower foundation.

3. The support structure of claim 1, wherein said diameters of said first and second upper ring members are of a generally similar diameter.

4. The support structure of claim 1, wherein said overlapping structural members are secured at overlapping points with fasteners.

5. The support structure of claim 1, wherein said structural members connected to said first upper ring are connected adjacent a lower surface thereof.

6. The support structure of claim 1, wherein said structural members connected to said second upper ring are connected adjacent an upper surface thereof.

7. A support structure, comprising:

an upper member;

a lower foundation; and a plurality of integral elastically deformed structural members rigidly secured to said upper member and said lower foundation, wherein the integral structural members radially extend at angular intervals from the upper member, and wherein a portion of adjacent integral structural members overlap a portion of adjacent structural members between the upper member and the lower foundation.

8. The support structure of claim 7, wherein a first plurality of structural members are connected to said upper member at a first vertical location thereof and wherein a second plurality of structural members are connected to said upper member at a second vertical location thereof, said second vertical location being lower than said first vertical location.

9. The support structure of claim 7, wherein said upper member comprises a first upper ring member having a diameter and a second upper ring member having a diameter.

10. The support structure of claim 9, wherein said plurality of structural members are alternately secured to said first upper ring member and said second upper ring member.

11. The support structure of claim 10, wherein said diameters of said first and second upper ring members are of a generally similar diameter.

12. The support structure of claim 7, wherein said structural members are secured to overlapping structural members at overlapping points with fasteners.

13. A process for creating a dome support structure comprising the steps of:

providing a first upper member, a second upper member, a plurality of elongated structural members, and a lower foundation;

placing the first upper member over the second upper member in an initial relative position, said first and second upper members each respectively including a plurality of said elongated structural members extending radially outwardly at angular intervals from said ring members, said structural members having a first and a second lateral end, said first lateral end of each of said structural member being secured to either said first upper member or said second upper member;

raising the first and second upper members to a predetermined elevation, and into a concentric position above a diameter of the lower foundation;

directing the second lateral end of said structural members downwardly toward the lower foundation, and securing said second lateral ends of said structural members to said lower foundation; and, modifying the rotational position of said first upper member relative to said second upper member, wherein said first upper member is at a position rotatable offset from its initial relative position.

14. The process of claim 13, wherein after said rotational relative position change of said first and second upper members, said structural members overlap adjacent structural members at cross points, further comprising the step of:

securing said structural members to adjacent structural members at such cross points.

15. The process of claim 13, wherein said first upper member and said second upper member are both rotated, the direction of rotation of said first member being opposite the direction of rotation of said second member.

16. The process claim 13, wherein after said rotational relative position change of said first upper member and said second upper member, said first and second upper members are secured to each other to prevent the members from assuming their original equilibrium state.

17. A process for creating a dome support structure comprising:

providing an upper member, a plurality of structural members and a lower foundation;

attaching the plurality of structural members, respectively, adjacent a first lateral end thereof to the upper member, said structural members extending radially outwardly at angular intervals from said upper member;

raising said upper member to a predetermined elevation;

connecting pairs of said structural members at substantially a second lateral end of said structural members, and directing said second lateral ends of said structural members toward one another;

connecting said pairs of said structural members at a location proximal said second lateral end of said structural members and directing portions of said structural members toward one another such that portions of said structural members overlap adjacent structural members;

connecting overlapping structural members with a fastener; and, connecting said second lateral ends of said structural members to the lower foundation.

18. The process of claim 17, wherein the step of attaching the plurality of structural members to the upper member comprises attaching said structural members to said upper member at an inclined angle.

19. The process of claim 17, wherein said upper member comprises a first ring member and a second ring member, and wherein the step of attaching the plurality of structural members to the upper member comprises attaching alternating structural members to the first ring member and second ring member, respectively.

20. The process of claim 17 further comprising the steps of:

attaching a support mechanism to said pair of structural members after said second lateral ends of said structural members are directed toward one another.

21. The process of claim 17, further comprising the step of:

grouping the structural members in an upper and a lower array.

22. The process of claim 17, further comprising the step of:

directing the structural members toward one another in a predetermined order.

23. The process of claims 20, further comprising the step of:

directing the structural members toward one another in a predetermined order.

24. A column less support structure, comprising:

an upper member;

a lower foundation; and, a plurality of integral elastically deformed structural members rigidly fixed to said upper member and said lower foundation, wherein the integral structural members radially extend at angular intervals from the upper member, wherein a portion of adjacent integral structural members overlap a portion of adjacent structural members between the upper member and the lower foundation, and wherein the upper member of the support structure is supported by the structural members and is not supported by vertical supports.

25. The column less support structure of claim 24, wherein said integral structural members comprising an upper array and a lower array elastically modified into a lattice formation of cross-overlapping S-shaped members between said upper member and said lower foundation.

26. The columness support structure of claim 25, wherein said cross-overlapping S-shaped structural members are joined together at the cross-overlapping locations, to create a single layer frame dome structure.

27. A self-supporting dome support structure, comprising:

an upper member;

a lower foundation; and, a plurality of structural members rigidly fixed to and radially extending from the upper member in overlapping arrays, the structural members extending downward and anchored to the lower foundation at an angular orientation, wherein the structural members of the overlapping arrays are elastically modified by twisting and bending each structural member into an S-shaped configuration, wherein after such elastic modification a portion of adjacent structural members overlap a portion of adjacent structural members along their length between the upper member and the lower foundation to form a lattice configuration, and wherein the overlapping structural members are secured to each other at overlapping locations.

28. The self-supporting dome support structure of claim 27, wherein the upper member comprises a hub.

* * * * *